US011293233B2

(12) United States Patent
Spencer et al.

(10) Patent No.: US 11,293,233 B2
(45) Date of Patent: Apr. 5, 2022

(54) EARTH-BORING TOOLS HAVING A GAUGE REGION CONFIGURED FOR REDUCED BIT WALK AND METHOD OF DRILLING WITH SAME

(71) Applicant: Baker Hughes Holdings LLC, Houston, TX (US)

(72) Inventors: Reed W. Spencer, Spring, TX (US); Brad Pierce, Houston, TX (US); Brian James Hayes, Finleyville, PA (US)

(73) Assignee: Baker Hughes Holdings LLC, Houston, TX (US)

( * ) Notice: Subject to any disclaimer, the term of this patent is extended or adjusted under 35 U.S.C. 154(b) by 0 days.

(21) Appl. No.: 16/651,962

(22) PCT Filed: Sep. 28, 2018

(86) PCT No.: PCT/US2018/053571
§ 371 (c)(1),
(2) Date: Mar. 27, 2020

(87) PCT Pub. No.: WO2019/068000
PCT Pub. Date: Apr. 4, 2019

(65) Prior Publication Data

US 2020/0263504 A1 Aug. 20, 2020

Related U.S. Application Data

(60) Provisional application No. 62/565,375, filed on Sep. 29, 2017.

(51) Int. Cl.
*E21B 7/06* (2006.01)
*E21B 10/42* (2006.01)
(Continued)

(52) U.S. Cl.
CPC ..... *E21B 10/55* (2013.01); *E21B 7/04* (2013.01); *E21B 7/064* (2013.01); *E21B 10/42* (2013.01);
(Continued)

(58) Field of Classification Search
CPC ..... E21B 7/064; E21B 17/1092
See application file for complete search history.

(56) References Cited

U.S. PATENT DOCUMENTS 4,499,795 A 2/1985 Radtke
4,545,441 A 10/1985 Williamson
(Continued)

FOREIGN PATENT DOCUMENTS

EP 0219992 A2 4/1987
EP 1116858 B1 2/2005
(Continued)

OTHER PUBLICATIONS

International Search Report for International Application No. PCT/US18/53577, dated Jan. 30, 2019, 8 pages.
(Continued)

*Primary Examiner* — Cathleen R Hutchins
(74) *Attorney, Agent, or Firm* — TraskBritt

(57) ABSTRACT

A drill bit comprises a bit body having a longitudinal axis and a blade extending radially outward from the longitudinal axis along a face region and axially along a gauge region. A gauge region includes a cutting element located proximate to an uphole edge of the blade in the gauge region. A remainder of the gauge region is free of cutting elements mounted thereon. A method of drilling a borehole comprises rotating the bit about the longitudinal axis, engaging a formation with cutting elements mounted to the face region, and increasing a lateral force applied substantially perpendicular to the longitudinal axis such that the cutting element engages
(Continued)

the formation and such that side cutting exhibited by the tool is initially minimal and substantially constant and subsequently increases in a substantially linear manner with increasing lateral force.

20 Claims, 4 Drawing Sheets

(51) Int. Cl.

| | |
|---|---|
| ***E21B 10/55*** | (2006.01) |
| ***E21B 7/04*** | (2006.01) |
| ***E21B 17/10*** | (2006.01) |
| ***E21B 10/43*** | (2006.01) |
| ***E21B 10/54*** | (2006.01) |
| *E21B 12/00* | (2006.01) |
| *B22F 5/00* | (2006.01) |
| *E21B 10/567* | (2006.01) |
| *E21B 10/62* | (2006.01) |

(52) U.S. Cl.
CPC ..... *E21B 10/43* (2013.01); *E21B 10/54* (2013.01); *E21B 17/1092* (2013.01); *B22F 2005/001* (2013.01); *E21B 10/5673* (2013.01); *E21B 10/62* (2013.01); *E21B 12/00* (2013.01)

(56) References Cited

U.S. PATENT DOCUMENTS

| | | | |
|---|---|---|---|
| 4,583,574 | A | 4/1986 | Wilhelm |
| 5,004,057 | A | 4/1991 | Tibbitts et al. |
| 5,163,524 | A | 11/1992 | Newton et al. |
| 5,437,343 | A | 8/1995 | Cooley et al. |
| 5,456,141 | A | 10/1995 | Hwa-Shan |
| 5,467,836 | A | 11/1995 | Grimes et al. |
| 5,608,162 | A | 3/1997 | Hwa-Shan |
| 5,678,644 | A | 10/1997 | Coy |
| 5,819,862 | A | 10/1998 | Matthias et al. |
| 5,904,213 | A | 5/1999 | Caraway et al. |
| 5,937,958 | A | 8/1999 | Mensa-Wilmot et al. |
| 5,957,223 | A | 9/1999 | Doster et al. |
| 5,967,245 | A | 10/1999 | Garcia et al. |
| 5,967,246 | A | 10/1999 | Caraway et al. |
| 5,967,247 | A | 10/1999 | Rudolf |
| 6,006,845 | A | 12/1999 | Illerhaus et al. |
| 6,112,836 | A | 9/2000 | Spaar et al. |
| 6,260,636 | B1 | 7/2001 | Cooley et al. |
| 6,321,862 | B1 * | 11/2001 | Beuershausen ..... E21B 10/46 175/393 |
| 6,349,780 | B1 | 2/2002 | Beuershausen |
| 6,394,198 | B1 | 5/2002 | Hall et al. |
| 6,394,199 | B1 | 5/2002 | Skyles et al. |
| 6,427,792 | B1 | 8/2002 | Roberts et al. |
| 6,427,797 | B1 | 8/2002 | Hui-Lung |
| 6,484,822 | B2 | 11/2002 | Watson et al. |
| 6,640,913 | B2 | 11/2003 | Lockstedt et al. |
| 6,926,099 | B2 | 8/2005 | Thigpen et al. |
| 6,935,444 | B2 | 8/2005 | Lund et al. |
| 7,318,492 | B2 | 1/2008 | Watson et al. |
| 7,798,256 | B2 | 9/2010 | Hoffmaster et al. |
| 7,860,696 | B2 | 12/2010 | Shilin |
| 7,926,596 | B2 | 4/2011 | Shen et al. |
| 8,051,923 | B2 | 11/2011 | Chen et al. |
| 8,061,456 | B2 | 11/2011 | Patel et al. |
| 8,127,863 | B2 | 3/2012 | Durairajan et al. |
| 8,145,465 | B2 | 3/2012 | Shilin |
| 8,172,010 | B2 | 5/2012 | Strachan |
| 8,356,679 | B2 | 1/2013 | Chen et al. |
| 8,727,036 | B2 | 5/2014 | Johnson et al. |
| 8,794,356 | B2 | 8/2014 | Lyons et al. |
| 8,820,441 | B2 | 9/2014 | James |
| 8,869,919 | B2 | 10/2014 | Shen et al. |
| 8,899,352 | B2 | 12/2014 | Johnson et al. |
| 8,905,163 | B2 | 12/2014 | Chen et al. |
| 8,973,685 | B2 | 3/2015 | Ersan et al. |
| 8,978,787 | B2 | 3/2015 | Ersan et al. |
| 9,080,390 | B2 | 7/2015 | Ersan et al. |
| 9,145,739 | B2 | 9/2015 | Hoffmaster et al. |
| 9,200,484 | B2 | 12/2015 | Cleboski et al. |
| 9,482,057 | B2 | 11/2016 | Digiovanni et al. |
| 9,677,344 | B2 | 6/2017 | Radford et al. |
| 2001/0000885 | A1 | 5/2001 | Beuershausen et al. |
| 2002/0100618 | A1 | 8/2002 | Watson et al. |
| 2003/0010534 | A1 | 1/2003 | Chen et al. |
| 2006/0157286 | A1 * | 7/2006 | Pope ..... E21B 10/567 175/374 |
| 2009/0020339 | A1 | 1/2009 | Sherwood, Jr. |
| 2010/0089648 | A1 | 4/2010 | Hall et al. |
| 2010/0089662 | A1 | 4/2010 | Mumma |
| 2011/0005837 | A1 | 1/2011 | Hoffmaster et al. |
| 2013/0098692 | A1 | 4/2013 | Wardley et al. |
| 2013/0153306 | A1 | 6/2013 | Burhan et al. |
| 2013/0180781 | A1 | 7/2013 | Ersan et al. |
| 2014/0116790 | A1 | 5/2014 | Hall et al. |
| 2015/0152723 | A1 | 6/2015 | Hay |
| 2016/0168914 | A1 | 6/2016 | Israel |
| 2018/0163482 | A1 | 6/2018 | Vempati et al. |
| 2019/0040691 | A1 | 2/2019 | Mayer et al. |
| 2019/0100968 | A1 | 4/2019 | Spencer et al. |

FOREIGN PATENT DOCUMENTS

| | | | |
|---|---|---|---|
| WO | 2017/132052 | A1 | 8/2017 |
| WO | 2018/118043 | A1 | 6/2018 |

OTHER PUBLICATIONS

International Search Report for International Application No. PCT/US18/53571, dated Jan. 25, 2019, 8 pages.
International Search Report for International Application No. PCT/US2018/053568, dated Feb. 22, 2019, 3 pages.
International Written Opinion for International Application No. PCT/US18/53571, dated Jan. 25, 2019, 9 pages.
International Written Opinion for International Application No. PCT/US18/53577, dated Jan. 30, 2019 10 pages.
International Written Opinion for International Application No. PCT/US2018/053568, dated Feb. 22, 2019, 10 pages.
Dictionary definition of "oblong", accessed Sep. 28, 2021 via thefreedictionary.com.

* cited by examiner

EARTH-BORING TOOLS HAVING A GAUGE REGION CONFIGURED FOR REDUCED BIT WALK AND METHOD OF DRILLING WITH SAME

PRIORITY CLAIM

This application is a national phase entry under 35 U.S.C. § 371 of International Patent Application PCT/US2018/053571, filed Sep. 28, 2018, designating the United States of America and published as International Patent Publication WO2019/068000 A1 on Apr. 4, 2019, which claims the benefit under 35 U.S.C. § 119(e) of U.S. Provisional Patent Application Ser. No. 62/565,375, filed Sep. 29, 2017, the disclosure of which is hereby incorporated herein in its entirety by this reference. The subject matter of this application is also related to the subject matter of U.S. application Ser. No. 16/147,041, entitled "Earth-Boring Tools Having a Selectively Tailored Gauge Region for Reduced Bit Walk and Method of Drilling with Same" filed Sep. 28, 2018, now U.S. Pat. No. 11,060,357, issued Jul. 13, 2021. The subject matter of this application is further related to the subject matter of U.S. application Ser. No. 16/651,970, filed Mar. 27, 2020, and titled "Earth-Boring Tools Having a Gauge Insert Configured for Reduced Bit Walk and Method of Drilling with Same."

TECHNICAL FIELD

The disclosure, in various embodiments, relates generally to earth-boring tools, such as drill bits, having radially and axially extending blades. More particularly, the disclosure relates to drill bits including a cutting element mounted in the gauge region thereof to decrease deviations of the drill bit while drilling a straight portion of a borehole.

BACKGROUND

Rotary drill bits are commonly used for drilling boreholes or wellbores in earth formations. One type of rotary drill bit is the fixed-cutter bit (often referred to as a "drag" bit). The process of drilling an earth formation may be visualized as a three-dimensional process, as the drill bit may not only penetrate the formation linearly along a vertical axis, but is either purposefully or unintentionally drilled along a curved path or at an angle relative to a theoretical vertical axis extending into the earth formation in a direction substantially parallel to the gravitational field of the earth, as well as in a specific lateral direction relative to the theoretical vertical axis. The term "directional drilling," as used herein, means both the process of directing a drill bit along some desired trajectory through an earth formation to a predetermined target location to form a borehole, and the process of directing a drill bit along a predefined trajectory in a direction other than directly downwards into an earth formation in a direction substantially parallel to the gravitational field of the earth to either a known or unknown target.

Several approaches have been developed for directional drilling. For example, positive displacement (Moineau) type motors as well as turbines have been employed in combination with deflection devices such as bent housings, bent subs, eccentric stabilizers, and combinations thereof to effect oriented, nonlinear drilling when the bit is rotated only by the motor drive shaft, and linear drilling when the bit is rotated by the superimposed rotation of the motor shaft and the drill string.

Other steerable bottom hole assemblies are known, including those wherein deflection or orientation of the drill string may be altered by selective lateral extension and retraction of one or more contact pads or members against the borehole wall. One such system is the AutoTrak™ drilling system, developed by the INTEQ operating unit of Baker Hughes, a GE company, LLC, assignee of the present disclosure. The bottom hole assembly of the AutoTrak™ drilling system employs a non-rotating sleeve through which a rotating drive shaft extends to drive the bit, the sleeve thus being decoupled from drill string rotation. The sleeve carries individually controllable, expandable, circumferentially spaced steering ribs on its exterior, the lateral forces exerted by the ribs on the sleeve being controlled by pistons operated by hydraulic fluid contained within a reservoir located within the sleeve. Closed loop electronics measure the relative position of the sleeve and substantially continuously adjust the position of each steering rib so as to provide a steady lateral force at the bit in a desired direction. Further, steerable bottom hole assemblies include placing a bent adjustable kick off (AKO) sub between the drill bit and the motor. In other cases, an AKO may be omitted and a side load (e.g., lateral force) applied to the drill string/bit to cause the bit to travel laterally as it descends downward.

The processes of directional drilling and deviation control are complicated by the complex interaction of forces between the drill bit and the wall of the earth formation surrounding the borehole. In drilling with rotary drill bits and, particularly with fixed-cutter type rotary drill bits, it is known that if a lateral force is applied to the drill bit, the drill bit may "walk" or "drift" from the straight path that is parallel to the intended longitudinal axis of the borehole. Many factors or variables may at least partially contribute to the reactive forces and torques applied to the drill bit by the surrounding earth formation. Such factors and variables may include, for example, the "weight on bit" (WOB), the rotational speed of the bit, the physical properties and characteristics of the earth formation being drilled, the hydrodynamics of the drilling fluid, the length and configuration of the bottom hole assembly (BHA) to which the bit is mounted, and various design factors of the drill bit.

DISCLOSURE

In some embodiments, a drill bit for removing subterranean formation material in a borehole comprises a bit body comprising a longitudinal axis, a blade extending radially outward from the longitudinal axis along a face region of the bit body and extending axially along a gauge region of the bit body, and a cutting element on the blade in the gauge region, the cutting element located proximate to an uphole edge. A remainder of the gauge region is free of cutting elements mounted thereon.

In further embodiments, a drill bit for removing subterranean formation material in a borehole comprises a bit body comprising a longitudinal axis, a blade extending radially outward from the longitudinal axis along a face region of the bit body and extending axially along a gauge region of the bit body, and at least one cutting element on the blade in the gauge region. The at least one cutting element is located in an upper quartile of the at least one blade in the gauge region such that a remainder of the gauge region beyond the upper quartile is free of cutting elements mounted thereon.

In other embodiments, a method of drilling a borehole in a subterranean formation comprises rotating a bit about a longitudinal axis thereof and engaging a subterranean formation with at least a portion of a gauge region of a blade of the bit. The gauge region comprises a cutting element on the blade in the gauge region, the cutting element located proximate to an uphole edge of the blade in the gauge region and a remainder of the gauge region is free of cutting elements mounted thereon. The method further comprises increasing a tilt angle of the bit such that the cutting element and the remainder of the gauge region consecutively engaged with the subterranean formation with increasing tilt angle.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

MODE(S) FOR CARRYING OUT THE INVENTION

Figure 1:
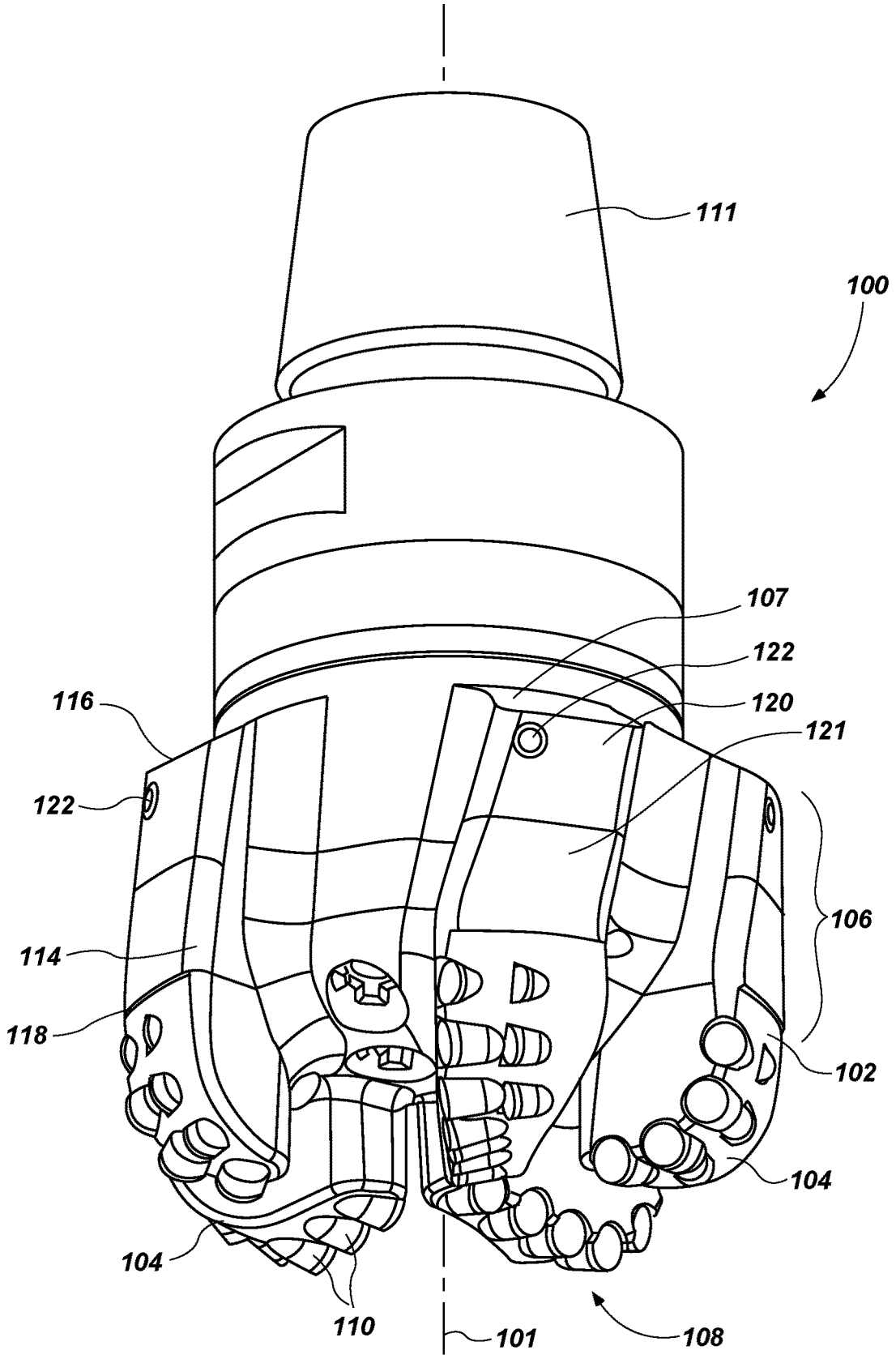
FIG. 1 is a perspective view of a drill bit according to embodiments of the disclosure.

The illustrations presented herein are not meant to be actual views of any particular cutting structure, drill bit, or component thereof, but are merely idealized representations, which are employed to describe embodiments of the present disclosure. For clarity in description, various features and elements common among the embodiments may be referenced with the same or similar reference numerals.

As used herein, directional terms, such as "above," "below," "up," "down," "upward," "downward," "top," "bottom," "upper," "lower," "top-most," "bottom-most," and the like, are to be interpreted relative to the earth-boring tool or a component thereof in the orientation of the figures.

As used herein, the terms "longitudinal," "longitudinally," "axial," or "axially" refers to a direction parallel to a longitudinal axis (e.g., rotational axis) of the drill bit described herein. For example, a "longitudinal dimension" or "axial dimension" is a dimension measured in a direction substantially parallel to the longitudinal axis of the drill bit described herein.

As used herein, the terms "radial" or "radially" refers to a direction transverse to a longitudinal axis of the drill bit described herein and, more particularly, refers to a direction as it relates to a radius of the drill bit described herein. For example, as described in further detail below, a "radial dimension" is a dimension measured in a direction substantially transverse (e.g., perpendicular) to the longitudinal axis of the drill bit as described herein.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

As used herein, the terms "comprising," "including," "containing," "characterized by," and grammatical equivalents thereof are inclusive or open-ended terms that do not exclude additional, unrecited elements or method steps, but also include the more restrictive terms "consisting of" and "consisting essentially of" and grammatical equivalents thereof.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features and methods usable in combination therewith should or must be excluded.

As used herein, the term "configured" refers to a size, shape, material composition, and arrangement of one or more of at least one structure and at least one apparatus facilitating operation of one or more of the structure and the apparatus in a predetermined way.

As used herein, the singular forms following "a," "an," and "the" are intended to include the plural forms as well, unless the context clearly indicates otherwise.

As used herein, the term "and/or" includes any and all combinations of one or more of the associated listed items.

As used herein, the term "earth-boring tool" means and includes any tool used to remove formation material and to form a bore (e.g., a borehole) through a earth formation by way of the removal of the formation material. Earth-boring tools include, for example, rotary drill bits (e.g., fixed-cutter or "drag" bits and roller cone or "rock" bits), hybrid bits including both fixed cutters and roller elements, coring bits, percussion bits, bi-center bits, reamers (including expandable reamers and fixed-wing reamers), and other so-called "hole-opening" tools.

As used herein, the term "cutting element" means and includes an element separately formed from and mounted to an earth-boring tool that is configured and positioned on the earth-boring tool to engage an earth (e.g., subterranean) formation to remove formation material therefrom during operation of the earth-boring tool to form or enlarge a borehole in the formation. By way of non-limiting example, the term "cutting element" includes tungsten carbide inserts and inserts comprising superabrasive materials as described herein.

As used herein, the term "superabrasive material" means and includes any material having a Knoop hardness value of about 3,000 Kgf/mm$^2$ (29,420 MPa) or more such as, but not limited to, natural and synthetic diamond, cubic boron nitride and diamond-like carbon materials.

As used herein, the term "polycrystalline material" means and includes any material comprising a plurality of grains or crystals of the material that are bonded directly together by inter-granular bonds. The crystal structures of the individual grains of the material may be randomly oriented in space within the polycrystalline material.

As used herein, the term "polycrystalline compact" means and includes any structure comprising a polycrystalline material formed by a process that involves application of pressure (e.g., compaction) to the precursor material or materials used to form the polycrystalline material.

FIG. 1 is a perspective view of a drill bit 100 according to embodiments of the disclosure. The drill bit 100 includes a bit body 102 having a longitudinal axis 101 about which the drill bit 100 rotates in operation. The bit body 102 comprises a plurality of blades 104 extending radially outward from the longitudinal axis 101 toward a gauge region 106 of the blade 104 and extending axially along the gauge region 106. Outer surfaces of the blades 104 may define at least a portion of a face region 108 and the gauge region 106 of the drill bit 100.

The bit body 102 of the drill bit 100 is typically secured to a hardened steel shank 111 having an American Petroleum Institute (API) thread connection for attaching the drill bit 100 to a drill string. The drill string includes tubular pipe and equipment segments coupled end to end between the drill bit and other drilling equipment at the surface. Equipment such as a rotary table or top drive may be used for rotating the drill string and the drill bit 100 within the borehole. Alternatively, the shank 111 of the drill bit 100 may be coupled directly to the drive shaft of a down-hole motor, which then may be used to rotate the drill bit 100, alone or in conjunction with a rotary table or top drive.

The bit body 102 of the drill bit 100 may be formed from steel. Alternatively, the bit body 102 may be formed from a particle-matrix composite material. Such bit bodies may be formed by embedding a steel blank in a carbide particulate material volume, such as particles of tungsten carbide (WC), and infiltrating the particulate carbide material with a liquefied metal material (often referred to as a "binder" material), such as a copper alloy, to provide a bit body substantially formed from a particle-matrix composite material.

A row of cutting elements 110 may be mounted to each blade 104 of the drill bit 100. For example, cutting element pockets may be formed in the blades 104, and the cutting elements 110 may be positioned in the cutting element pockets and bonded (e.g., brazed, bonded, etc.) to the blades 104. The cutting elements 110 may comprise, for example, a polycrystalline compact in the form of a layer of hard polycrystalline material, referred to in the art as a polycrystalline table, that is provided on (e.g., formed on or subsequently attached to) a supporting substrate with an interface therebetween. In some embodiments, the cutting elements 110 may comprise polycrystalline diamond compact (PDC) cutting elements each including a volume of superabrasive material, such as polycrystalline diamond material, supported on a ceramic-metal composite material substrate. Though the cutting elements 110 in the embodiment depicted in FIG. 1 are cylindrical or disc-shaped, the cutting elements 110 may have any desirable shape, such as a dome, cone, chisel, etc. In operation, the drill bit 100 may be rotated about the longitudinal axis 101. As the bit 100 is rotated under applied WOB, the cutting elements 110 may engage a subterranean formation mounted in the face region 108 of the bit such that the cutting elements 110 exceed a compressive strength of the subterranean formation and penetrate the formation to remove formation material therefrom in a shearing cutting action.

The gauge region 106 of each blade 104 may be an axially extending region of each blade 104. The gauge region 106 may be defined by a rotationally leading edge 112 opposite a rotationally trailing edge 114 and an uphole edge 116 opposite a downhole edge 118. The uphole edge 116 is adjacent to a crown chamfer 107 of the bit 100 proximal to a shank 111 of the bit 100 and distal from the face region 108 of the bit 100. As used herein, the terms "downhole" and "uphole" refer to locations within the gauge region relative to portions of the drill bit 100 such as the face region 108 of the bit 100 that engage the bottom of a wellbore to remove formation material. The uphole edge 116 is located closer to (e.g., proximate to, adjacent to) to the shank 111 of the bit 100 or to an associated drill string or bottom hole assembly as compared to the downhole edge 118 that is located closer to (e.g., proximate to, adjacent to) the face region 108 of the bit 100.

The gauge region 106 may be divided (e.g., bisected) into a first and second region including an uphole region 120 and a downhole region 121, respectively. The uphole region 120 may be referred to herein as a "recessed region" as the uphole region 120 is radially recessed relative to the downhole region 121 of the gauge region 106, which is illustrated by a dashed line in FIG. 3, and relative to the outer diameter of the bit 100. The uphole region 120 may be located proximate to the uphole edge 116 of the gauge region 106. In some embodiments, an outer surface of the blade 104 in the recessed region 120 may be recessed relative to an outer diameter of the bit body 102 by a radial distance $d_{120}$ in a range extending from about 0.005 inch (0.127 mm) to about 0.100 inch (2.54 mm). Accordingly, a diameter of the bit 100 is defined by the outer surfaces of the blade 104 in the recessed region 120 may be recessed relative to an outer diameter of the bit body 102 by a diametric distance in a range extending from about 0.010 inch (0.254 mm) to about 0.200 inch (5.08 mm). The downhole region 121 of the blade 104 may also be recessed relative to the outer diameter of the bit body 102 by a radial distance $d_{121}$ in a range extending from about 0.005 inch (0.127 mm) to about 0.100 inch (0.254 mm). Accordingly, substantially the entire gauge region 106 may be recessed relative to the outer diameter of the bit body 102.

At least one cutting element 122 may be mounted on the blade 104 in the gauge region 106. As illustrated in FIG. 1, a single cutting element 122 may be mounted on the blade 104 such that a remainder of the gauge region 106 may be free of (e.g., devoid of) cutting elements. The cutting element 122 may be mounted proximate to the uphole edge 116. In some embodiments, the cutting element 122 may be mounted within an uphole half of the gauge region 106. In other embodiments, the cutting element 122 may be mounted within an upper quartile of the gauge region 106. By way of non-limiting example, the cutting element 122 may be mounted within about 1.000 inch (2.54 mm) or within about 0.500 inch (12.7 mm) of the uphole edge 116 as measured from a center of the cutting element 122. Accordingly, the cutting element 122 may be mounted in the uphole region 120. In some embodiments, the cutting element 122 may be mounted in the front quartile of the gauge region 106. By way of non-limiting example, the cutting element 122 may be mounted within about 0.500 inch (12.7 mm) or within about 0.270 inch (6.858 mm) from the rotationally leading edge 112.

Figure 2:
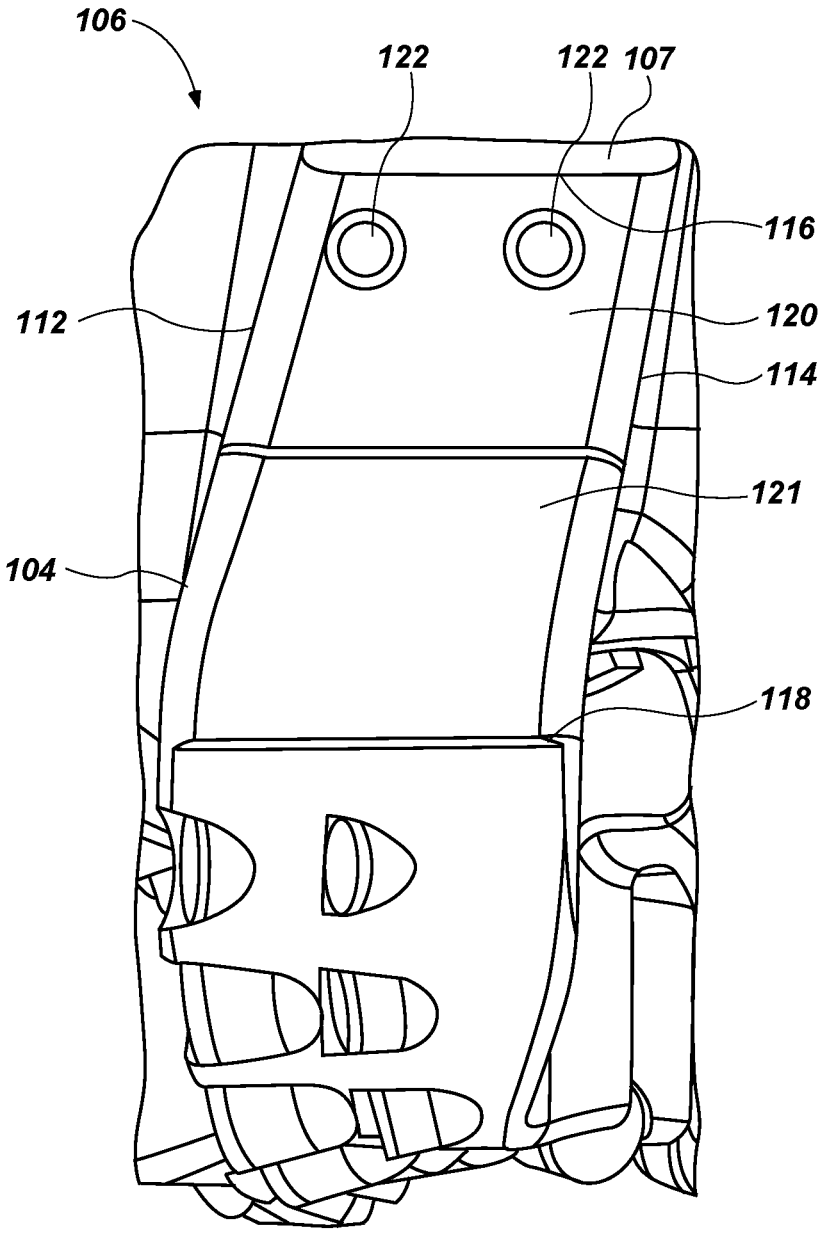
FIG. 2 is an enlarged side view of a gauge region of the drill bit of FIG. 1.

In other embodiments, as illustrated in FIG. 2, a plurality of cutting elements 122 (e.g., two, three, or more) may be mounted on the blade 104. The cutting elements 122 may be mounted proximate to the uphole edge 116 such as within an uphole half of the gauge region 106 or an upper quartile of the gauge region 106. A remainder of the gauge region 106 beyond the upper quartile of the gauge region 106 may be free of cutting element. In such embodiments, a first cutting element 122 may be located proximate (e.g., adjacent) to the rotationally leading edge 112, and a second cutting element 122 may be located proximate to the rotationally trailing edge 114. By way of non-limiting example, the cutting elements 122 may be mounted within about 0.500 inch (12.7 mm) or within about 0.270 inch (6.858 mm) from the respective rotationally leading edge 112 or trailing edge 114 proximate to which each is located.

The cutting elements 122 may comprise a volume of superabrasive material 124, such as a diamond table, disposed on a substrate 126. The volume of superabrasive material 124 may comprise a polycrystalline diamond (PCD) material, having a cutting face 128 defined thereon. Additionally, an interface 130 may be defined between the substrate 126 and the volume of superabrasive material 124. The substrate 126 may include a cemented carbide material, such as a cemented tungsten carbide material, in which tungsten carbide particles are cemented together in a metallic binder material. The metallic binder material may include, for example, cobalt, nickel, iron, or alloys and mixtures thereof. The cutting face 128 may be a substantially planar surface and may provide a substantially blunt surface in contact with the formation. A diameter of the cutting element 122 may be selected to extend in a range from about 0.39 inch (10 mm) to about 0.75 inch (19 mm) and, more particularly, may be about 0.43 inch (11 mm) or about 0.63 inch (16 mm).

Figure 3:
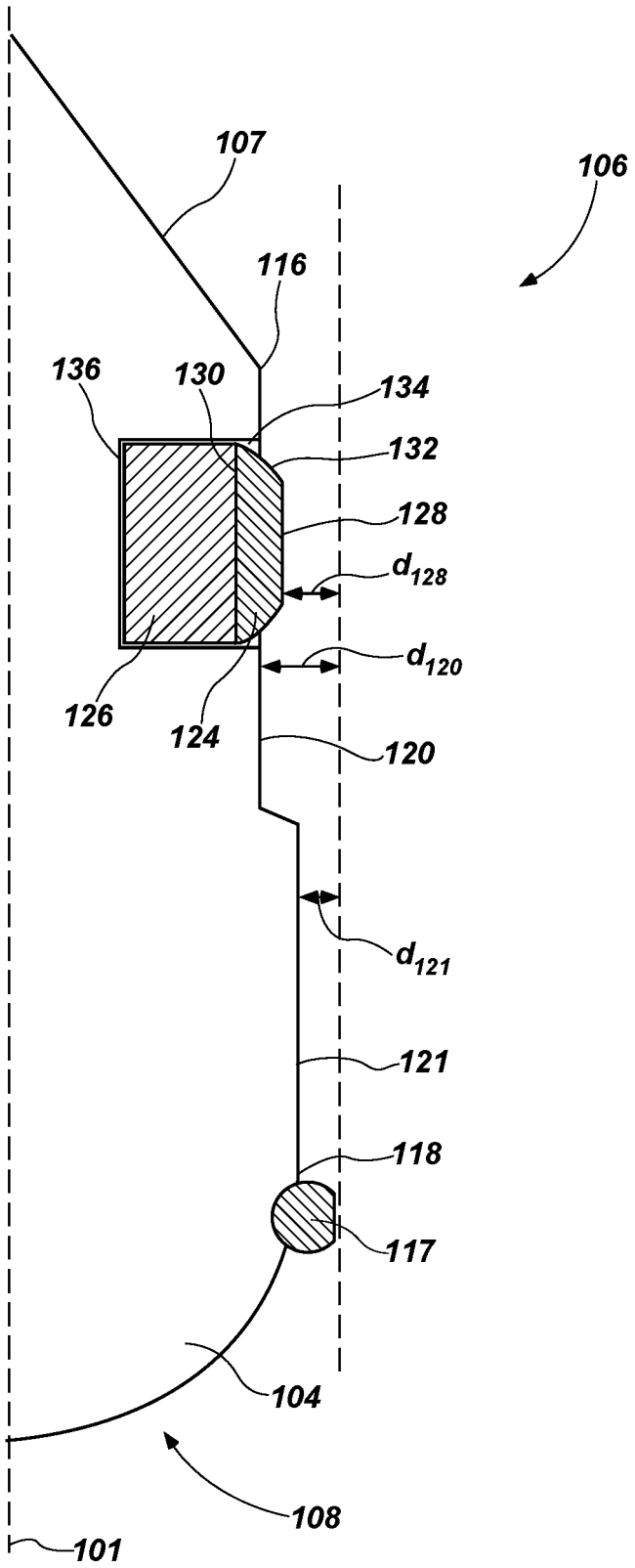
FIG. 3 is a cross-sectional view of a portion of the gauge region of FIG. 2.

In some embodiments, the volume of superabrasive material 124 may comprise at least one chamfer surface. As illustrated in FIG. 3, the volume of superabrasive material 124 comprises a multi-chamfered edge. A first chamfer surface 132 may be provided at a radial periphery of the volume of superabrasive material 124 such as radially about the cutting face 128. A second chamfer surface 134 may encircle (e.g., extend radially outward relative to) the first chamfer surface 132.

In other embodiments, the cutting element 122 may comprise a sharp cutting element, or a cutting element lacking a chamfer surface about the cutting face 128. In further embodiments, the cutting element 122 may have one or more recesses formed in the cutting face such as described in U.S. Pat. No. 9,482,057 issued to DiGiovanni et al., entitled "Cutting Elements for Earth-boring Tools, Earth-boring Tools Including Such Cutting Elements, and Related Methods," the disclosure of which is incorporated herein in its entirety by this reference. In yet other embodiments, the cutting element 122 may comprise a dome-shaped or hemispherical-shaped feature that is known in the art as an "ovoid."

As best illustrated in the cross-sectional view of FIG. 3, the cutting elements 122 may be disposed in a pocket 136 formed in the blade 104 in the gauge region 106. The cutting elements 122 may be mounted such that the substrate 126 is radially recessed relative to an outer surface of the blade 104 and enclosed within the pocket 136, and such that at least a portion of the superabrasive material 124 extends radially beyond the outer surface of the blade 104. More particularly, the first chamfer surface 132 extends radially beyond the outer surface of the blade 104, while the second chamfer surface 134 is radially recessed relative to the outer surface of the blade 104.

The cutting element 122 may be mounted in the pocket 136 at a large back rake range such that the cutting face 128 may substantially face a sidewall of the borehole in which the drill bit 100 is rotated. In some embodiments, the cutting element 122 may be mounted at a back rake angle greater than 80 degrees such as within a range from about 85 degrees to about 90 degrees, from about 87 degrees to about 90 degrees, or at a back rake angle of about 89 degrees.

The cutting element 122 may be mounted on the blade 104 in the gauge region 106 such that the cutting face 128 thereof is radially recessed relative to the outer diameter of the bit body 102. In some embodiments, the outer diameter of the drill bit 100 may be defined by a gage trimmer 117 mounted adjacent the downhole edge 118 of the gauge region 106. The cutting face 128 may be recessed relative to the outer diameter of the drill bit 100 by a radial distance $d_{128}$ in a range extending from about 0.005 inch (0.127 mm) to about 0.100 inch (0.254 mm), in a range extending from about 0.005 inch (0.127 mm) to about 0.050 inch (1.27 mm) and, more particularly, may be recessed by a distance of about 0.025 inch (0.635 mm). Accordingly, the cutting face 128 may be recessed relative to the outer diameter of the drill bit 100 by a diametric distance (e.g., twice the radial distance) in a range extending from about 0.010 inch (0.254 mm) to about 0.200 inch (0.508 mm), in a range extending from about 0.010 inch (0.254 mm) to about 0.100 inch (2.54 mm) and, more particularly, may be recessed by a distance of about 0.050 inch (1.27 mm). The cutting face 128 may extend radially beyond outer surfaces of the blade 104 in the uphole region 120 and/or the downhole region 121. In some embodiments, the cutting face 128 of the cutting element 122 may define a radially outermost surface of the gauge region 106.

The drill bit 100 may be coupled to a drill string including a steerable bottom hole assembly configured to directionally drill a borehole. In some embodiments, the steerable bottom hole assembly may comprise positive displacement (Moineau) type motors as well as turbines have been employed in combination with deflection devices such as bent housings, bent subs, eccentric stabilizers, and combinations thereof to effect oriented, nonlinear drilling when the bit is rotated only by the motor drive shaft, and linear drilling when the bit is rotated by the superimposed rotation of the motor shaft and the drill string. In other embodiments, the steerable bottom hole assemblies may comprise a bent adjustable kick off (AKO) sub.

Figure 4:
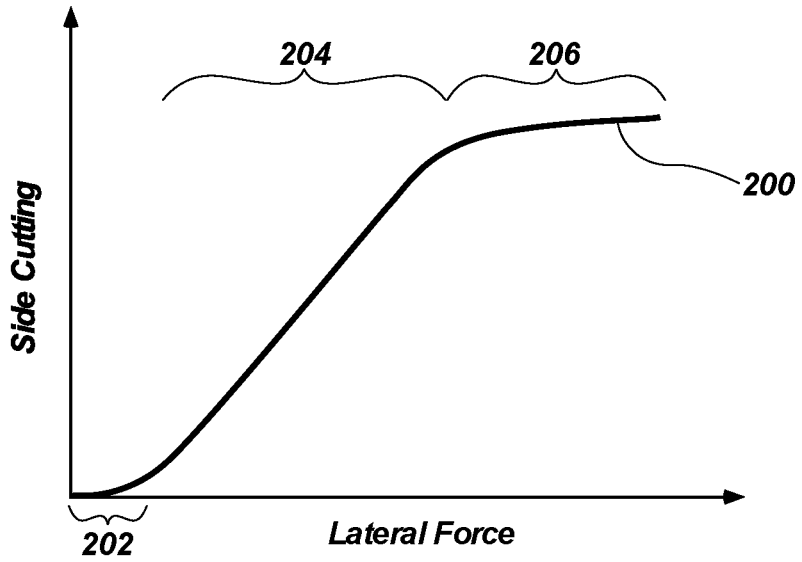
FIG. 4 is a graph illustrating the relationship between side cutting exhibited by the drill bit of FIG. 1 as a function of lateral force applied to the bit.

FIG. 4 is a graph of a line 200 illustrating an amount of side cutting of the drill bit 100 as a function of increasing lateral force (e.g., force applied in a direction substantially transverse or perpendicular to the longitudinal axis 101) applied to the bit 100 during operation thereof. The ability of the drill bit 100 to cut the borehole sidewall as opposed to the bottom of the borehole is referred to in the art as "side cutting." The amount of walk or drift may depend on the rate at which the drill bit 100 side cuts the borehole sidewall relative to an intended side cutting rate. As illustrated in FIG. 4, at low lateral forces, such as lateral forces less than about 500 pounds depending at least upon the formation material and the compressive strength thereof and upon the size of the bit 100, the amount of side cutting exhibited by the bit 100 is minimal and relatively constant. Accordingly, this region 202 of the line 200 is referred to as the "insensitive region" as the bit 100 is minimally responsive to (e.g., insensitive to) minimal applications of lateral force. Such low lateral forces are generally unintentionally applied to the drill bit 100 while the bit 100 is forming a straight portion of the borehole, such as a vertical portion or a horizontal (e.g., lateral) portion of the borehole. Side cutting while drilling the straight portion of the borehole may be substantially avoided as side cutting while forming the straight portion of the borehole leads to walk or drift of the bit 100 and causes the borehole to deviate from its intended path. Furthermore, side cutting while drilling the straight portion of the borehole may also lead to undesirable tortuosity, torque, and drag problems, which may lower the quality of the borehole and limit the length of the straight portion thereof that can be formed. Accordingly, the insensitivity of the drill bit 100 to low lateral forces is desirable because limiting side cutting in the straight portion of the borehole will decrease the potential walk or drift of the bit 100 and improve the quality and length of the straight portions of the borehole.

While side cutting may be undesirable at low lateral forces when drilling the straight portion of the borehole as previously described, side cutting may be desirable at greater side loads when drilling curved portions of the borehole. Such side cutting enables the bit 100 to directionally drill so as to form deviated or curved portions of the borehole in an efficient manner. Accordingly, at moderate lateral forces, such as lateral forces greater than 500 pounds (226.7 kilograms) and up to about 1500 pounds (680.2 kilograms) depending at least upon the formation material and the compressive strength thereof and upon the size of the bit 100, the amount of side cutting exhibited by the gauge region 106 of the bit 100 begins to increase in a substantially constant, linear manner. This region 204 of the line 200 is referred to as the "linear region." At high lateral forces, such as lateral forces greater than about 1500 pounds (680.2 kilograms) depending at least upon the formation material and the compressive strength thereof and upon the size of the bit 100, the amount of side cutting exhibited by the bit 100 is maximized and plateaus, or caps. Accordingly, this region 206 of the line 200 is referred to as the "cap region." In view of the foregoing, the gauge region 106 of the drill bit 100 may be shaped and topographically configured such as by recessing the gauge region 106 relative to the outer diameter of the bit 100 to limit side cutting of the bit 100 while drilling a substantially straight portion of a borehole without limiting side cutting of the bit 100 while drilling a curved (e.g., deviated) portion of the borehole. Overall, as illustrated in FIG. 4, as the lateral force applied on the bit 100 increases, the cutting element 122 in the gauge region 106 of the bit 100 engages the subterranean formation and subsequently a remainder of outer surfaces of the blade 104 in the gauge region 106 engage the subterranean formation, the side cutting exhibited by the bit 100 may be initially minimal and substantially constant, may subsequently increase in a substantially linear manner with increasing lateral force, and may be subsequently maximized and substantially constant.

Without being bound by any particular theory, the amount of side cutting performed by the gauge region 106 of the blade 104 may be at least partially a function of the surface area and/or volume of the gauge region 106 in contact with the formation material at a given lateral force. Therefore, according to embodiments of the present disclosure, the drill bit 100 and, more particularly, the gauge region 106 is designed and topographically configured to selectively control the surface area and/or volume of the gauge region 106 in contact with the sidewall of the borehole as a function of bit tilt angle of the bit 100 and/or lateral force applied to the bit 100. As used herein, the term "bit tilt angle" refers to an angle measured between the longitudinal axis 101 of the bit 100 and a borehole axis extending centrally through the borehole. As the drill bit 100 is operated to form the straight portion of the borehole, the drill bit 100 is generally oriented such that the longitudinal axis 101 of the bit 100 is substantially coaxial with the borehole axis. The bit tilt angle of the bit 100 may be at least partially a function of the lateral force applied to the bit 100 such that as the amount of lateral force applied to the bit 100 increases, the bit tilt angle of the bit 100 increases correspondingly. When the bit tilt angle is zero (e.g., when the longitudinal axis 101 is substantially coaxial with the borehole axis), the gauge region 106 and, more particularly, the cutting element 122 may not be in contact with the formation. When the bit tilt angle is greater than zero, at least a portion of the gauge region 106 and, more particularly, the cutting element 122 may come into contact with the borehole sidewall and remove formation material when sufficient lateral force is applied prior to a remainder of the gauge region 106 contacting the borehole sidewall. The gauge region 106 of bit 100 may be designed such that the anticipated surface area and/or volume of the gauge region 106 contacting the formation at a given lateral force and/or given bit tilt angle is selectively controlled and/or tailored.

Figure 5:
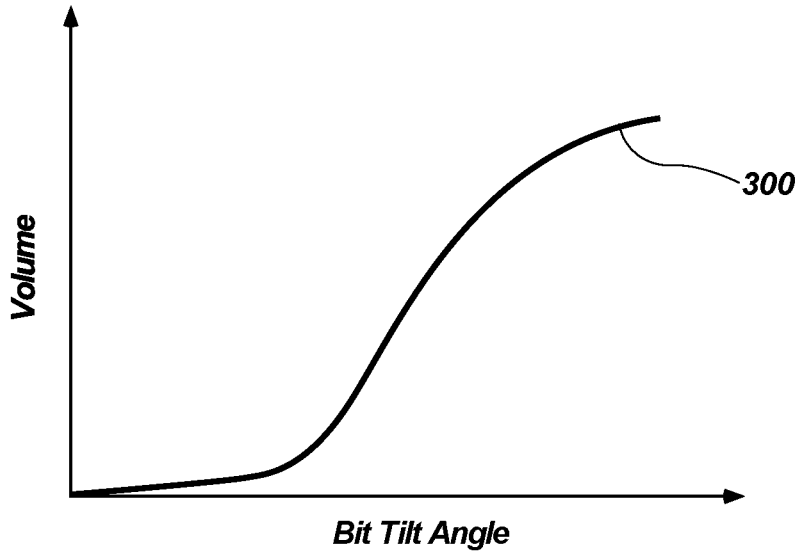
FIG. 5 is a graph illustrating the relationship between a volume of engagement of the drill bit of FIG. 1 as a function of bit tilt angle.

FIG. 5 is a graph of a line 300 illustrating a volume of the gauge region 106 in contact with the formation material of the borehole sidewall as a function of increasing bit tilt angle. When lateral forces are applied to the bit 100 and the longitudinal axis 101 of the bit 100 is inclined relative to the borehole axis, the cutting element 122 may contact the formation material of the borehole wall prior to the remainder of the gauge region 106 including outer surfaces of the blade 104 in the uphole region 120 and the downhole region 121. Further, the gauge region 106 is sized and configured such that as the bit tilt angle increases with application of low lateral forces as previously described herein, the volume of the gauge region 106 in contact with the formation, if any, remains minimal and substantially constant. As a result, the amount of side cutting performed by the gauge region 106 may be limited and substantially constant over the range of low lateral forces as previously described with regard to the insensitive region of the line 200 of FIG. 4. Further, the size of the insensitive region, or the range of lateral forces over which the amount of side cutting is minimal and relatively constant, can be reduced or extended by tailoring the shape and topography of the gauge region 106 including the cutting element 122, the uphole region 120, and the downhole region 121. For instance, one or more of the distance by which the cutting element 122 is recessed relative to the outer diameter of the bit 100, the distance by which the cutting element 122 extends beyond the outer surface of the blade 104, the back rake angle at which the cutting element 122 is mounted, and one or more dimensions of the superabrasive material 124 of the cutting element 122 including, but not limited to, a diameter of the cutting element 122 and an angle at which the chamfer surfaces 132, 134 are formed may be modified or otherwise tailored to adjust the volume of the gauge region 106 that will contact the sidewall of the borehole.

At low lateral forces, such as forces less than about 500 pounds (226.7 kilograms) depending at least upon the formation material and the compressive strength thereof and upon the size of the bit 100, the cutting element 122 may ride, rub on, or otherwise engage the borehole sidewall without substantially failing the formation material of the sidewall (e.g., without exceeding the compressive strength of the formation). In other words, at low lateral forces the cutting element 122 does not provide substantial side cutting action.

As the bit tilt angle increases so as to steer or direct the drill bit 100 away from the linear path of the substantially vertical portion of the borehole, the cutting element 122 in the gauge region 106 of the bit 100 may engage a borehole sidewall and penetrate the formation material thereof so as to remove formation material. As the bit tilt angle increases, outer surfaces of the blade 104 in the uphole region 120 and the downhole region 121 may increasing engage the formation and increase the volume of the gauge region 106 in contact with the formation material until the bit tilt angle is sufficiently high that substantially all of the volume of the gauge region 106 is in contact with the formation. Further, as previously described, the gauge region 106 of the bit 100 includes a recessed uphole region 120. By providing the recessed region at the top of the gauge region 106, the amount of contact between the gauge region 106 and the formation may be reduced, which enables the bit 100 to deviate from the vertical portion toward a substantially horizontal portion of the borehole, referred to as the "build up rate," over a shorter distance.

Accordingly, in operation, the drill bit 100 may exhibit the amount of side-cutting as a function of increasing lateral force and/or volume of the gauge region 106 engagement as a function of bit tilt angle as previously described with reference to FIGS. 4 and 5. By configuring the gauge region 106 of the drill bit 100 such that the anticipated volume of the gauge region 106 contacting the formation at a given lateral force and/or given bit tilt angle is selectively controlled and/or tailored and particularly such that a low lateral forces and small bit tilt angles the gauge region 106 does not substantially engage the formation material of the borehole sidewall, the drill bit 100 exhibits a decreased potential to walk or drift as the drill bit 100 is used to directionally drill a borehole and may improve the quality and length of the straight portions of the borehole.

Additional non limiting example embodiments of the disclosure are described below:

Embodiment 1

A drill bit for removing subterranean formation material in a borehole comprises a bit body comprising a longitudinal axis, at least one blade extending radially outward from the longitudinal axis along a face region of the bit body and extending axially along a gauge region of the bit body, and a single cutting element on the at least one blade in the gauge region. The cutting element is located proximate to an uphole edge of the at least one blade in the gauge region, and a remainder of the gauge region of the at least one blade is free of cutting elements mounted thereon.

Embodiment 2

The drill bit of Embodiment 1, wherein the cutting element is mounted on the at least one blade at a back rake angle in a range extending from about 85 degrees to about 90 degrees.

Embodiment 3

The drill bit of either of Embodiments 1 or 2, wherein the cutting element is radially recessed relative to an outer diameter of the drill bit.

Embodiment 4

The drill bit of any of Embodiments 1 through 3, wherein the cutting element is radially recessed relative to the outer diameter of the drill bit by a distance in a range from about 0.010 inch (0.254 mm) to about 0.100 inch (2.54 mm).

Embodiment 5

The drill bit of any of Embodiments 1 through 4, wherein the cutting element is radially recessed relative to the outer diameter of the drill bit by a distance of about 0.025 inch (0.635 mm).

Embodiment 6

The drill bit of any of Embodiments 1 through 5, wherein the cutting element comprises a superabrasive table on a substrate, and wherein the cutting element is mounted on the at least one blade such that at least a portion of the superabrasive table of the cutting element extends radially beyond an outer surface of the at least one blade in the gauge region.

Embodiment 7

The drill bit of any of Embodiments 1 through 6, wherein the superabrasive table comprises a chamfered edge, and wherein the chamfered edge extends radially beyond the outer surface of the at least one blade in the gauge region.

Embodiment 8

The drill bit of any of Embodiments 1 through 7, wherein the superabrasive table comprises multiple chamfered edges, and wherein one chamfered edge of the multiple chamfered edges extends radially beyond the outer surface of the at least one blade in the gauge region and at least one other chamfered edge of the multiple chamfered edges extends radially below the outer surface of the at least one blade in the gauge region.

Embodiment 9

The drill bit of any of Embodiments 1 through 8, wherein at least a first portion of the blade in the gauge region is recessed relative to a second portion of the at least one blade in the gauge region, the first portion located uphole relative to the second portion, and wherein the cutting element is mounted in the first portion of the at least one blade.

Embodiment 10

The drill bit of any of Embodiments 1 through 9, wherein the cutting element is mounted adjacent a rotationally leading edge of the at least one blade.

Embodiment 11

A directional drilling system comprising a steerable bottom hole assembly operably coupled to the drill bit of any of Embodiments 1 through 10.

Embodiment 12

A drill bit for removing subterranean formation material in a borehole comprises a bit body comprising a longitudinal axis, at least one blade extending radially outward from the longitudinal axis along a face region of the bit body and extending axially along a gauge region of the bit body, and at least one cutting element on the at least one blade in the gauge region. The at least one cutting element is located in an upper quartile of the at least one blade in the gauge region such that a remainder of the gauge region beyond the upper quartile is free of cutting elements mounted thereon.

Embodiment 13

The drill bit of Embodiment 12, wherein the at least one cutting element is radially recessed relative to an outer diameter of the bit body.

Embodiment 14

The drill bit of either of Embodiments 12 or 13, wherein the at least one cutting element comprises a superabrasive table on a substrate, and wherein the cutting element is mounted on the at least one blade such that at least a portion of the superabrasive table of the cutting element extends radially beyond an outer surface of the at least one blade in the gauge region.

Embodiment 15

The drill bit of any of Embodiments 12 through 14, wherein a cutting face of the at least one cutting element extends radially beyond outer surfaces of the blade in the gauge region.

Embodiment 16

A method of drilling a borehole in a subterranean formation comprises rotating a bit about a longitudinal axis thereof within the borehole and engaging a sidewall of the borehole with at least a portion of a gauge region of at least one blade of the bit. The gauge region comprises a cutting element on the at least one blade in the gauge region and located proximate to an uphole edge of the at least one blade in the gauge region. A remainder of the gauge region is free of cutting elements mounted thereon. The method further comprises increasing a tilt angle of the bit such that the cutting element and the remainder of the gauge region are consecutively engaged with the sidewall of the borehole with increasing tilt angle.

Embodiment 17

The method of Embodiment 16, wherein increasing the tilt angle of the bit comprises increasing a lateral force applied on the bit in a direction substantially perpendicular to the longitudinal axis such that the cutting element and the remainder of the gauge region consecutively engage the sidewall of the borehole and such that side cutting exhibited by the bit is initially minimal and substantially constant and subsequently increases in a substantially linear manner with increasing lateral force as an increasing volume of the cutting element engages the sidewall of the borehole.

Embodiment 18

The method of either of Embodiments 16 or 17, wherein increasing the lateral force applied on the bit such that side cutting exhibited by the bit is initially minimal and substantially constant comprises maintaining a substantially constant volume of the cutting element in contact with the sidewall of the borehole with increasing applied lateral force.

Embodiment 19

The method of any of Embodiments 16 through 18, wherein increasing the lateral force applied on the bit such that side cutting exhibited by the bit is increased in a substantially linear manner with increasing lateral force comprises increasing a volume of the cutting element penetrating the sidewall of the borehole with increasing applied lateral force.

Embodiment 20

The method of any of Embodiments 16 through 19, further comprising increasing a lateral force applied on the bit in a direction substantially perpendicular to the longitudinal axis such that side cutting exhibited by the bit is subsequently maximized and substantially constant after increasing side cutting exhibited by the bit in the substantially linear manner and such that substantially an entire volume of the gauge region engages the sidewall of the borehole.

While the disclosed structures and methods are susceptible to various modifications and alternative forms in implementation thereof, specific embodiments have been shown by way of example in the drawings and have been described in detail herein. However, it should be understood that the present disclosure is not limited to the particular forms disclosed. Rather, the present invention encompasses all modifications, combinations, equivalents, variations, and alternatives falling within the scope of the present disclosure as defined by the following appended claims and their legal equivalents.

What is claimed is:

1. A drill bit for removing subterranean formation material in a borehole, comprising:

a bit body comprising a longitudinal axis;

at least one blade extending radially outward from the longitudinal axis along a face region of the bit body and extending axially along a gauge region of the bit body, the at least one blade in the gauge region comprising:

a first portion comprising a first outer surface at least partially defining a first diameter of the bit body; and a second portion comprising a second outer surface at least partially defining a second diameter of the bit body, the first diameter being smaller than the second diameter; and a single cutting element on the first portion of the at least one blade in the gauge region, the single cutting element located proximate to an uphole edge of the at least one blade in the gauge region, a cutting face of the single cutting element being radially recessed relative to an outer diameter of the drill bit and extending radially beyond the first outer surface, wherein a remainder of the gauge region of the at least one blade is free of cutting elements mounted thereon.

2. The drill bit of claim 1, wherein the single cutting element is mounted on the at least one blade at a back rake angle in a range extending from about 85 degrees to about 90 degrees.

3. The drill bit of claim 1, wherein the single cutting element is radially recessed relative to the outer diameter of the drill bit by a distance in a range from about 0.010 inch (0.254 mm) to about 0.100 inch (2.54 mm).

4. The drill bit of claim 1, wherein the single cutting element is radially recessed relative to the outer diameter of the drill bit by a distance of about 0.025 inch (0.635 mm).

5. The drill bit of claim 1, wherein the single cutting element comprises a superabrasive table on a substrate, and wherein the single cutting element is mounted on the at least one blade such that at least a portion of the superabrasive table of the single cutting element extends radially beyond the first outer surface of the first portion of the at least one blade in the gauge region.

6. The drill bit of claim 5, wherein the superabrasive table comprises a chamfered surface, and wherein the chamfered surface extends radially beyond the first outer surface.

7. The drill bit of claim 5, wherein the superabrasive table comprises multiple chamfered surfaces, and wherein one chamfered surface of the multiple chamfered surfaces extends radially beyond the first outer surface of the first portion of the at least one blade in the gauge region and at least one other chamfered surface of the multiple chamfered surfaces extends radially below the first outer surface.

8. The drill bit of claim 1, wherein the first portion of the at least one blade in the gauge region is located uphole relative to the second portion.

9. The drill bit of claim 1, wherein the single cutting element is mounted adjacent a rotationally leading edge of the at least one blade.

10. A directional drilling system comprising a steerable bottom hole assembly operably coupled to the drill bit of claim 1.

11. The drill bit of claim 1, wherein the second portion of the at least one blade in the gauge region is radially recessed relative to the outer diameter of the drill bit.

12. A drill bit for removing subterranean formation material in a borehole, comprising:

a bit body comprising a longitudinal axis;

at least one blade extending radially outward from the longitudinal axis along a face region of the bit body and extending axially along a gauge region of the bit body, the at least one blade in the gauge region comprising:

a first portion comprising a first outer surface at least partially defining a first diameter of the bit body; and a second portion comprising a second outer surface at least partially defining a second diameter of the bit body, the first diameter being smaller than the second diameter; and at least one cutting element on the first portion of the at least one blade in the gauge region, the at least one cutting element located in an upper quartile of the at least one blade in the gauge region such that a remainder of the gauge region beyond the upper quartile is free of cutting elements mounted thereon, a cutting face of the at least one cutting element being radially recessed relative to an outer diameter of the drill bit and extending radially beyond the first outer surface in the upper quartile of the at least one blade in the gauge region.

13. The drill bit of claim 12, wherein the at least one cutting element comprises a superabrasive table on a substrate.

14. The drill bit of claim 13, wherein the cutting face of the at least one cutting element extends radially beyond the second outer surface of the second portion of the blade in the gauge region.

15. The drill bit of claim 12, wherein the second portion of the at least one blade in the gauge region is radially recessed relative to the outer diameter of the drill bit.

16. A method of drilling a borehole in a subterranean formation, comprising:

rotating a bit about a longitudinal axis thereof within the borehole;

engaging a sidewall of the borehole with at least a portion of a gauge region of at least one blade of the bit, the gauge region comprising:

a cutting element on the at least one blade in the gauge region, the cutting element located proximate to an uphole edge of the at least one blade in the gauge region, wherein a remainder of the gauge region is free of cutting elements mounted thereon;

increasing a tilt angle of the bit such that the cutting element and the remainder of the gauge region are consecutively engaged with the sidewall of the borehole with increasing tilt angle; and increasing a lateral force applied on the bit in a direction substantially perpendicular to the longitudinal axis such that the cutting element and the remainder of the gauge region further consecutively engage the sidewall of the borehole and such that side cutting exhibited by the bit is initially minimal and substantially constant and subsequently increases in a substantially linear manner with increasing lateral force as an increasing volume of the cutting element engages the sidewall of the borehole.

17. The method of claim 16, wherein increasing the lateral force applied on the bit such that side cutting exhibited by the bit is initially minimal and substantially constant comprises maintaining a substantially constant volume of the cutting element in contact with the sidewall of the borehole with increasing applied lateral force.

18. The method of claim 16, wherein increasing the lateral force applied on the bit such that side cutting exhibited by the bit is increased in a substantially linear manner with increasing lateral force comprises increasing a volume of the cutting element penetrating the sidewall of the borehole with increasing applied lateral force.

19. The method of claim 16, further comprising increasing a lateral force applied on the bit in a direction substantially perpendicular to the longitudinal axis such that side cutting exhibited by the bit is subsequently maximized and substantially constant after increasing side cutting exhibited by the bit in the substantially linear manner and such that substantially an entire volume of the gauge region engages the sidewall of the borehole.

20. The method of claim 16, wherein engaging a sidewall of the borehole with at least a portion of a gauge region of at least one blade of the bit comprises engaging the sidewall of the borehole with a cutting face of the cutting element, the cutting face being radially recessed relative to an outer diameter of the bit and extending radially beyond an outer surface of the at least one blade in the gauge region.

* * * * *